US011854733B2

(12) United States Patent
Saito et al.

(10) Patent No.: US 11,854,733 B2
(45) Date of Patent: Dec. 26, 2023

(54) COIL COMPONENT

(71) Applicant: TDK CORPORATION, Tokyo (JP)

(72) Inventors: Masataro Saito, Tokyo (JP); Masazumi Arata, Tokyo (JP); Hokuto Eda, Tokyo (JP); Kohei Takahashi, Tokyo (JP); Takamasa Iwasaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 341 days.

(21) Appl. No.: 17/108,023

(22) Filed: Dec. 1, 2020

(65) Prior Publication Data

US 2021/0166858 A1 Jun. 3, 2021

(30) Foreign Application Priority Data

Dec. 3, 2019 (JP) ..... 2019-218752

(51) Int. Cl.

| | |
|---|---|
| ***H01F 5/00*** | (2006.01) |
| ***H01F 27/28*** | (2006.01) |
| ***H01F 27/32*** | (2006.01) |
| ***H01F 27/29*** | (2006.01) |

(52) U.S. Cl.

CPC ..... *H01F 27/2804* (2013.01); *H01F 27/29* (2013.01); *H01F 27/323* (2013.01); *H01F 2027/2809* (2013.01)

(58) Field of Classification Search

CPC ..... H01F 27/2804
USPC ..... 336/221
See application file for complete search history.

(56) References Cited

U.S. PATENT DOCUMENTS

2013/0147592 A1* 6/2013 Yoo ..... H01F 5/003 336/200
2015/0035634 A1* 2/2015 Nakamura ..... H01F 41/046 336/170
2017/0133145 A1* 5/2017 Hong ..... H01F 17/0013

FOREIGN PATENT DOCUMENTS

JP 2001-160510 A 6/2001
JP 2017-092444 A 5/2017

OTHER PUBLICATIONS

English translation of JP2005050956 (Year: 2005).*
Oct. 17, 2023 Office Action issued in Japanese Patent Application No. 2019-218752.

* cited by examiner

*Primary Examiner* — Ronald Hinson
(74) *Attorney, Agent, or Firm* — Oliff PLC

(57) ABSTRACT

In a coil component, a double coil is configured of a first coil portion and a second coil portion, and a first through conductor of the first coil portion and a second through conductor of the second coil portion are adjacent to each other. Thus, the first coil portion and the second coil portion have enhanced magnetic coupling at locations (that is, the first through conductor and the second through conductor) at which planar coil patterns of upper and lower surfaces of an insulating substrate are connected, in addition to magnetic coupling in the planar coil patterns wound around a through hole. Therefore, according to the coil component, a high coupling coefficient between the first coil portion and the second coil portion is realized.

4 Claims, 8 Drawing Sheets

COIL COMPONENT

CROSS-REFERENCE TO RELATED APPLICATIONS

This application is based upon and claims the benefit of priority from Japanese Patent Application No. 2019-218752, filed on 3 Dec. 2019, the entire contents of which are incorporated herein by reference.

TECHNICAL FIELD

The present disclosure relates to a coil component.

BACKGROUND

Japanese Unexamined Patent Publication No. 2017-92444 (Patent Literature 1) discloses a coil component in which a double coil is formed by a pair of coil patterns provided on one surface of a substrate and a pair of coil patterns provided on the other surface of the substrate.

SUMMARY

In the configuration of the coil component according to the above-described conventional technique, it has been difficult to obtain a high coupling coefficient in the double coil. After diligent research, the inventors have found a new technology which can realize a high coupling coefficient in a double coil.

According to the disclosure, a coil component having an improved coupling coefficient in a double coil is provided.

A coil component according to an aspect of the disclosure includes an elementary body having a first end surface and a second end surface parallel to each other; an insulating substrate provided in the elementary body, the insulating substrate being orthogonal to the first end surface and the second end surface and extending between the first end surface and the second end surface; a first coil portion including a first planar coil pattern, a second planar coil pattern, and a first through conductor, the first planar coil pattern provided on one surface of the insulating substrate and wound around a magnetic core located on an equidistant line in which a distance from the first end surface and a distance from the second end surface are equal when seen in a thickness direction of the insulating substrate and having an inner end portion located on the equidistant line and an outer end portion extending to the first end surface of the elementary body, the second planar coil pattern provided on the other surface of the insulating substrate and having an inner end portion overlapping the inner end portion of the first planar coil pattern and an outer end portion extending to the second end surface of the elementary body when seen in the thickness direction of the insulating substrate, the first through conductor piercing the insulating substrate in the thickness direction on the equidistant line when seen in the thickness direction of the insulating substrate and connecting the inner end portion of the first planar coil pattern to the inner end portion of the second planar coil pattern; a second coil portion including a third planar coil pattern, a fourth planar coil pattern, and a second through conductor, the third planar coil pattern provided on the one surface of the insulating substrate to be wound parallel to the first planar coil pattern and having an inner end portion adjacent to the inner end portion of the first planar coil pattern on an outer peripheral side of the first planar coil pattern and an outer end portion extending to the first end surface of the elementary body on the equidistant line when seen in the thickness direction of the insulating substrate, the fourth planar coil pattern provided on the other surface of the insulating substrate and having an inner end portion overlapping the inner end portion of the third planar coil pattern and an outer end portion extending to the second end surface of the elementary body when seen in the thickness direction of the insulating substrate, the second through conductor piercing the insulating substrate in the thickness direction to be adjacent to the first through conductor on the equidistant line when seen in the thickness direction of the insulating substrate and connecting the inner end portion of the third planar coil pattern to the inner end portion of the fourth planar coil pattern; a first external terminal electrode provided on the first end surface of the elementary body and connected to the outer end portion of the first planar coil pattern; a second external terminal electrode provided on the second end surface of the elementary body and connected to the outer end portion of the second planar coil pattern; a third external terminal electrode provided on the first end surface of the elementary body and connected to the outer end portion of the third planar coil pattern; and a fourth external terminal electrode provided on the second end surface of the elementary body and connected to the outer end portion of the fourth planar coil pattern.

In the coil component, a double coil is configured of the first coil portion and the second coil portion, and the first through conductor of the first coil portion and the second through conductor of the second coil portion are adjacent to each other. Thus, magnetic coupling is enhanced at locations (that is, the first through conductor and the second through conductor) at which the planar coil patterns on one surface of the insulating substrate and the planar coil patterns on the other surface of the insulating substrate are connected, and a coupling coefficient between the first coil portion and the second coil portion is improved.

In the coil component according to another aspect of the disclosure, the number of turns of the first coil portion may be larger than the number of turns of the second coil portion. In this case, a value of inductance of the first coil portion and a value of inductance of the second coil portion can be made different from each other.

In the coil component according to another aspect of the disclosure, a pattern shape of the first planar coil pattern and a pattern shape of the second planar coil pattern may be line symmetric with respect to the equidistant line, and a pattern shape of the third planar coil pattern and a pattern shape of the fourth planar coil pattern may be line symmetric with respect to the equidistant line when seen in the thickness direction of the insulating substrate. When the pattern shapes have symmetry in this way, a manufacturing process can be simplified.

In the coil component according to another aspect of the disclosure, the first planar coil pattern, the second planar coil pattern, the third planar coil pattern, and the fourth planar coil pattern may be configured by plating, and the first planar coil pattern and the third planar coil pattern provided on the one surface of the insulating substrate, and the second planar coil pattern and the fourth planar coil pattern provided on the other surface of the insulating substrate may be separated by resin walls.

DETAILED DESCRIPTION

Figure 1:
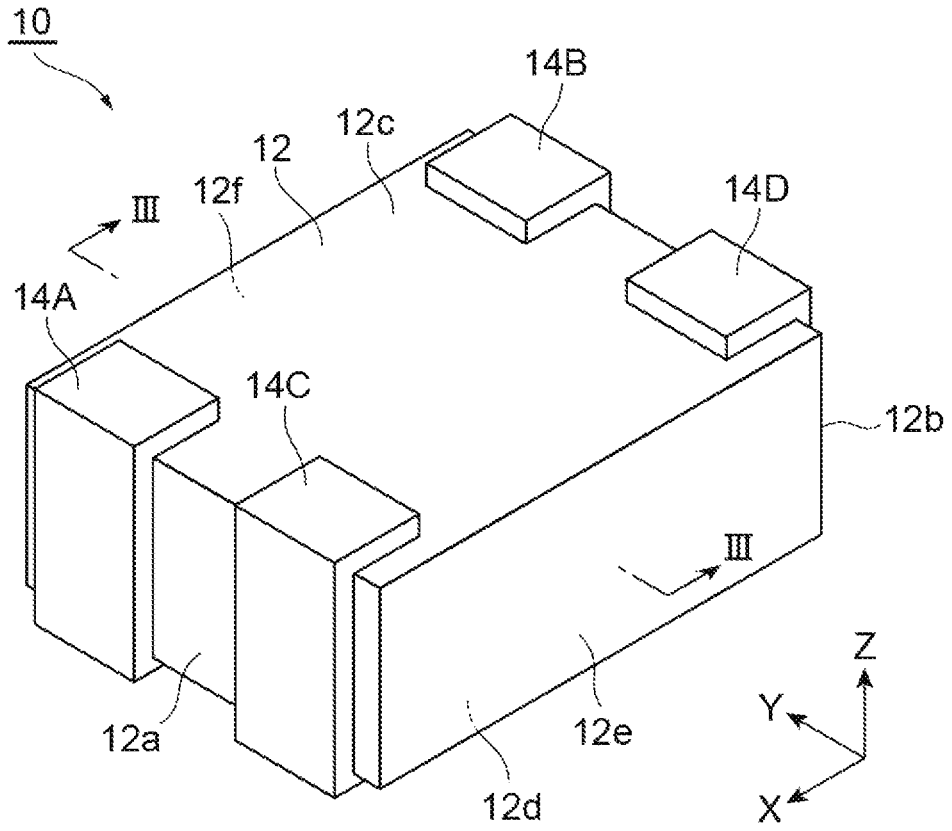
FIG. 1 is a schematic perspective view of a coil component according to an embodiment.

Hereinafter, embodiments of the disclosure will be described in detail with reference to the accompanying drawings. In the description, the same reference numerals are used for the same elements or elements having the same function, and duplicate description thereof will be omitted.

A structure of a coil component 10 according to an embodiment will be described with reference to FIGS. 1 to 4.

The coil component 10 is configured of a main body 12 (an elementary body) having a rectangular parallelepiped shape, and two pairs of external terminal electrodes 14A, 14B, 14C, and 14D provided on a surface of the main body 12. The two pairs of external terminal electrodes 14A, 14B, 14C, and 14D are respectively provided on end surfaces 12*a* and 12*b* of the main body 12 which are parallel to each other. As an example, the coil component 10 is designed with dimensions of a long side of 2.5 mm, a short side of 2.0 mm, and a height of 0.8 to 1.0 mm.

Hereinafter, for convenience of explanation, XYZ coordinates are set as shown in the drawing. That is, a thickness direction of the main body is set to a Z direction, a facing direction of the end surfaces 12*a* and 12*b* on which the external terminal electrodes are provided is set to an X direction, and a direction orthogonal to the Z direction and the X direction is set to a Y direction.

Figure 2:
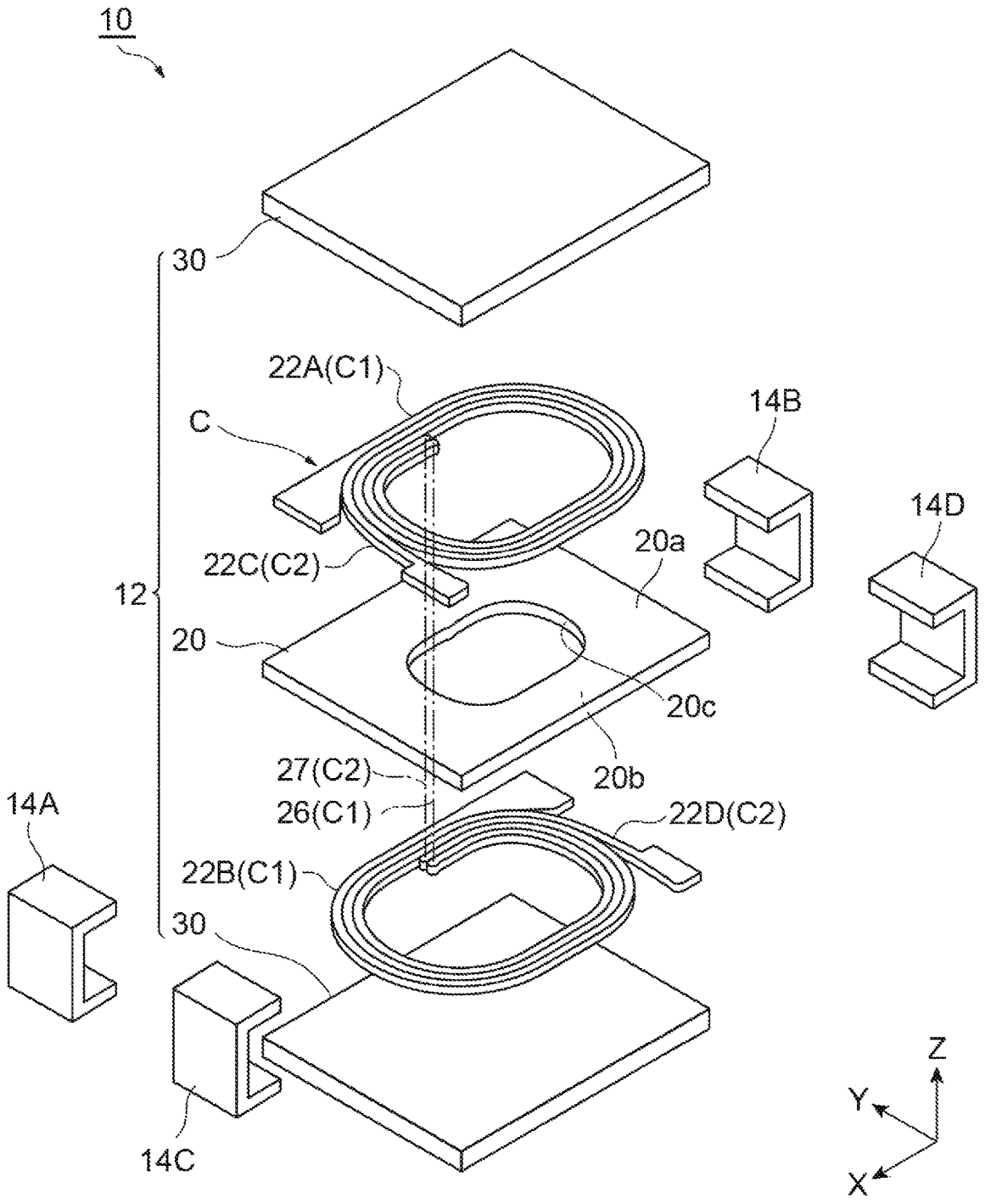
FIG. 2 is an exploded view of the coil component shown in FIG. 1.
Figure 3:
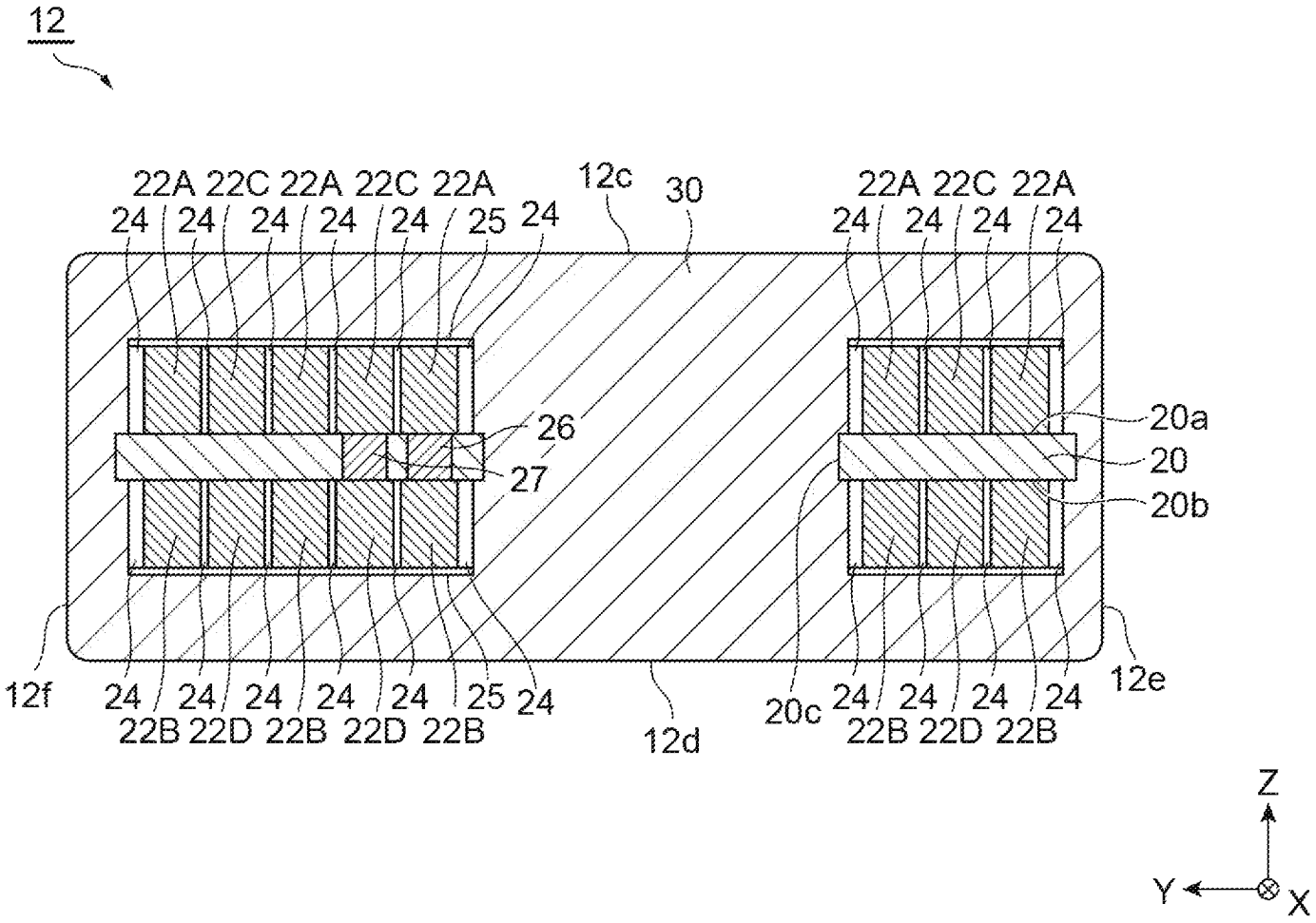
FIG. 3 is a sectional view taken along line III-III of the coil component shown in FIG. 1.

As shown in FIG. 2, the main body 12 includes an insulating substrate 20, a coil C provided on the insulating substrate 20, and a magnetic body 30.

The insulating substrate 20 is a plate-shaped member having a rectangular shape provided inside the main body 12, and is made of a non-magnetic insulating material. The insulating substrate 20 extends between the end surfaces 12*a* and 12*b* and is designed to be orthogonal to the end surfaces 12*a* and 12*b*. An elliptical through hole 20*c* is provided in a central portion of the insulating substrate 20. A substrate in which a glass cloth is impregnated with an epoxy resin and which has a plate thickness of 10 μm to 60 μm can be used as the insulating substrate 20. In addition to an epoxy resin, a BT resin, polyimide, aramid and the like can also be used. Ceramic or glass can also be used as the material of the insulating substrate 20. The material of the insulating substrate 20 may be a mass-produced printed circuit board material, and may be a resin material, in particular, one used for a BT printed circuit board, a FR4 printed circuit board, or an FR5 printed circuit board.

The coil C includes a first coil portion C1 and a second coil portion C2 which form a double coil structure. The first coil portion C1 includes a first planar coil pattern 22A having a planar spiral shape and provided on an upper surface 20*a* (one surface) of the insulating substrate 20, a second planar coil pattern 22B having a planar spiral shape and provided on a lower surface 20*b* (the other surface) of the insulating substrate 20, and a first through conductor 26 which connects the first planar coil pattern 22A to the second planar coil pattern 22B. The second coil portion C2 includes a third planar coil pattern 22C having a planar spiral shape and provided on the upper surface 20*a* of the insulating substrate, a fourth planar coil pattern 22D having a planar spiral shape and provided on the lower surface 20*b* of the insulating substrate 20, and a second through conductor 27 which connects the third planar coil pattern 22C to the fourth planar coil pattern 22D.

The first planar coil pattern 22A of the first coil portion C1 and the third planar coil pattern 22C of the second coil portion C2 are wound on the upper surface 20*a* of the insulating substrate 20 to be adjacent and parallel to each other. Further, the second planar coil pattern 22B of the first coil portion C1 and the fourth planar coil pattern 22D of the second coil portion C2 are wound on the lower surface 20*b* of the insulating substrate 20 to be adjacent and parallel to each other.

Each of the planar coil patterns 22A, 22B, 22C, and 22D has a rectangular cross section and is designed so that heights from the insulating substrate 20 are the same as each other. Each of the through conductors 26 and 27 is provided to pierce the insulating substrate 20 in the thickness direction and has, for example, a substantially cylindrical or substantially prismatic exterior. Each of the through conductors 26 and 27 may be configured of a hole provided in the insulating substrate 20 and a conductive material (for example, a metal material such as Cu) filled into the hole.

Resin walls 24 are provided between the first planar coil patterns 22A and the third planar coil patterns 22C wound parallel to each other on the upper surface 20*a* of the insulating substrate, and the first planar coil patterns 22A and the third planar coil patterns 22C are physically and electrically separated from each other by the resin walls 24. Further, the resin walls 24 are also provided on the outer side of the outermost turn and the inner side of the innermost turn of the first planar coil patterns 22A. In the embodiment, the resin walls 24 located on the outer side of the outermost peripheral turn and the inner side of the innermost peripheral turn of the first planar coil pattern 22A are designed to be thicker than the resin walls 24 located between the first planar coil pattern 22A and the third planar coil pattern 22C.

Each of the resin walls 24 is also provided between the second planar coil pattern 22B and the fourth planar coil pattern 22D wound parallel to each other on the lower surface 20*b* of the insulating substrate, and the second planar coil pattern 22B and the fourth planar coil pattern 22D are physically and electrically separated from each other by each of the resin walls 24. Further, the resin walls 24 are also provided on the outer side of the outermost peripheral turn and the inner side of the innermost peripheral turn of the second planar coil pattern 22B. In the embodiment, the resin walls 24 located on the outer side of the outermost peripheral turn and the inner side of the innermost peripheral turn of the second planar coil pattern 22B are designed to be thicker than the resin walls 24 located between the second planar coil pattern 22B and the fourth planar coil pattern 22D.

The resin walls 24 are made of an insulating resin material. The resin walls 24 can be provided on the insulating substrate 20 before each of the planar coil patterns 22A, 22B, 22C, and 22D is formed, and in this case, each of the planar coil patterns 22A, 22B, 22C, and 22D is plated and grown between walls defined in the resin walls 24. That is, formation regions of the planar coil patterns 22A, 22B, 22C, and 22D are defined by the resin walls 24 provided on the insulating substrate 20. The resin walls 24 can be provided on the insulating substrate 20 after the planar coil patterns 22A, 22B, 22C, and 22D are formed, and in this case, the resin walls 24 are provided on the planar coil patterns 22A, 22B, 22C, and 22D by filling or coating.

A height of each of the resin walls 24 (that is, heights with respect to the insulating substrate 20) is designed to be higher than the heights of the planar coil patterns 22A, 22B, 22C, and 22D. Therefore, a creepage distance between adjacent planar coil patterns 22A, 22B, 22C, and 22D via the resin wall 24 is increased, as compared with a case in which the height of the resin wall 24 and the heights of the planar coil patterns 22A, 22B, 22C, and 22D are the same. Thus, it is possible to curb situations in which short circuiting occurs between adjacent planar coil patterns 22A, 22B, 22C, and 22D.

An insulating layer 25 is interposed between adjacent resin walls 24. The insulating layer 25 is provided over the entire upper surface of each of the planar coil patterns 22A, 22B, 22C, and 22D between adjacent resin walls 24. The insulating layer 25 is made of a resin such as an epoxy resin or a polyimide resin and is formed using a photolithography method.

The magnetic body 30 integrally covers the insulating substrate 20 and the coil C. More specifically, the magnetic body 30 covers the insulating substrate 20 and the coil C from above and below and covers the outer periphery of the insulating substrate 20 and the coil C. Further, the magnetic body 30 fills the inside of the through hole 20*c* of the insulating substrate 20 and an inner region of the coil C.

The magnetic body 30 is made of a metal magnetic component-containing resin. The metal magnetic component-containing resin is a binder powder in which metal magnetic powder is bound by a binder resin. The metal magnetic powder of the metal magnetic component-containing resin constituting the magnetic body 30 is configured of, for example, an iron-nickel alloy (a Permalloy alloy), carbonyl iron, an amorphous or crystalline FeSiCr-based alloy, Sendust, or the like. The binder resin is, for example, a thermosetting epoxy resin. In the embodiment, a content of the metallic magnetic powder in the binder powder is 80 to 92 vol % in percentage by volume and 95 to 99 wt % in percentage by mass. From the viewpoint of magnetic properties, the content of the metal magnetic powder in the binder powder may be 85 to 92 vol % in percentage by volume and 97 to 99 wt % in percentage by mass. The magnetic component of the metal magnetic component-containing resin constituting the magnetic body 30 may be a powder having one kind of average particle diameter, or may be a mixed powder having a plurality of kinds of average particle diameter. In the embodiment, the magnetic component of the metal magnetic component-containing resin constituting the magnetic body 30 is a mixed powder having three kinds of average particle diameter. When the magnetic component of the metal magnetic component-containing resin constituting the magnetic body 30 is a mixed powder, the kinds of magnetic components having different average particle diameters may be the same as or different from each other.

The two pairs of external terminal electrodes 14A, 14B, 14C, and 14D provided on the end surfaces 12*a* and 12*b* of the main body 12 are respectively connected to outer end portions 22*a* of the corresponding planar coil patterns 22A, 22B, 22C, and 22D. That is, the first external terminal electrode 14A provided on the end surface 12*a* (a first end surface) is connected to the outer end portion 22*a* of the first planar coil pattern 22A, the second external terminal electrode 14B provided on the end surface 12*b* (a second end surface) is connected to the outer end portion 22*a* of the second planar coil pattern 22B, the third external terminal electrode 14C provided on the end surface 12*a* is connected to the outer end portion 22*a* of the third planar coil pattern 22C, and the fourth external terminal electrode 14D provided on the end surface 12*b* is connected to the outer end portion 22*a* of the fourth planar coil pattern 22D.

The first external terminal electrode 14A and the second external terminal electrode 14B face each other in the X direction, and the third external terminal electrode 14C and the fourth external terminal electrode 14D face each other in the X direction.

Next, a pattern shape of each of the planar coil patterns 22A, 22B, 22C, and 22D will be described in more detail with reference to FIGS. 4 to 8. Alternate long and short dash lines in FIGS. 4 to 8 indicate equidistant lines L having the same distance from the end surface 12*a* and the same distance from the end surface 12*b* when seen in the thickness direction of the insulating substrate 20.

All of the four planar coil patterns 22A, 22B, 22C, and 22D are wound around the through hole 20*c* provided in the central portion of the insulating substrate 20. A magnetic core of the coil C is configured of the magnetic material 30 which fills the inside of the through hole 20*c* of the insulating substrate 20 and the inner region of the coil C, and the magnetic core of the coil C is located on the equidistant line L.

Each of the planar coil patterns 22A, 22B, 22C, and 22D has the outer end portion 22*a* which reaches the end surface 12*a* or the end surface 12*b* of the main body 12 and is exposed, an inner end portion 22*b* provided on a peripheral edge of the through hole 20*c*, a winding portion 22*c* which connects the outer end portion 22*a* to the inner end portion 22*b*.

Figure 4:
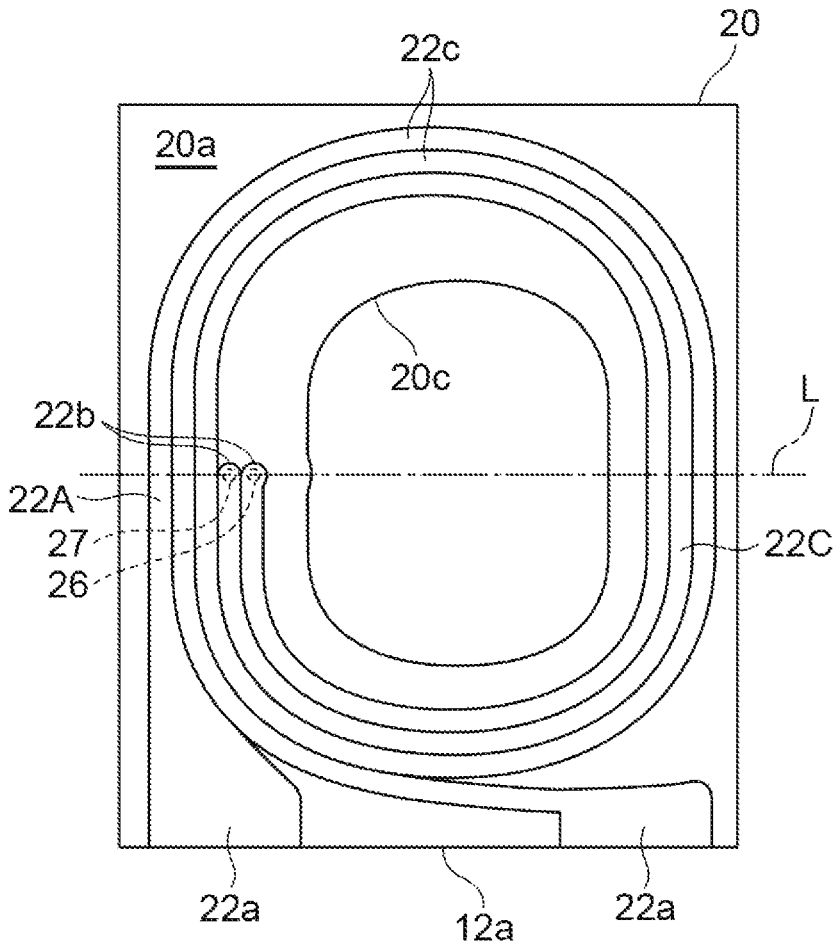
FIG. 4 is a view showing a planar coil pattern provided on an upper surface of a substrate.
Figure 5:
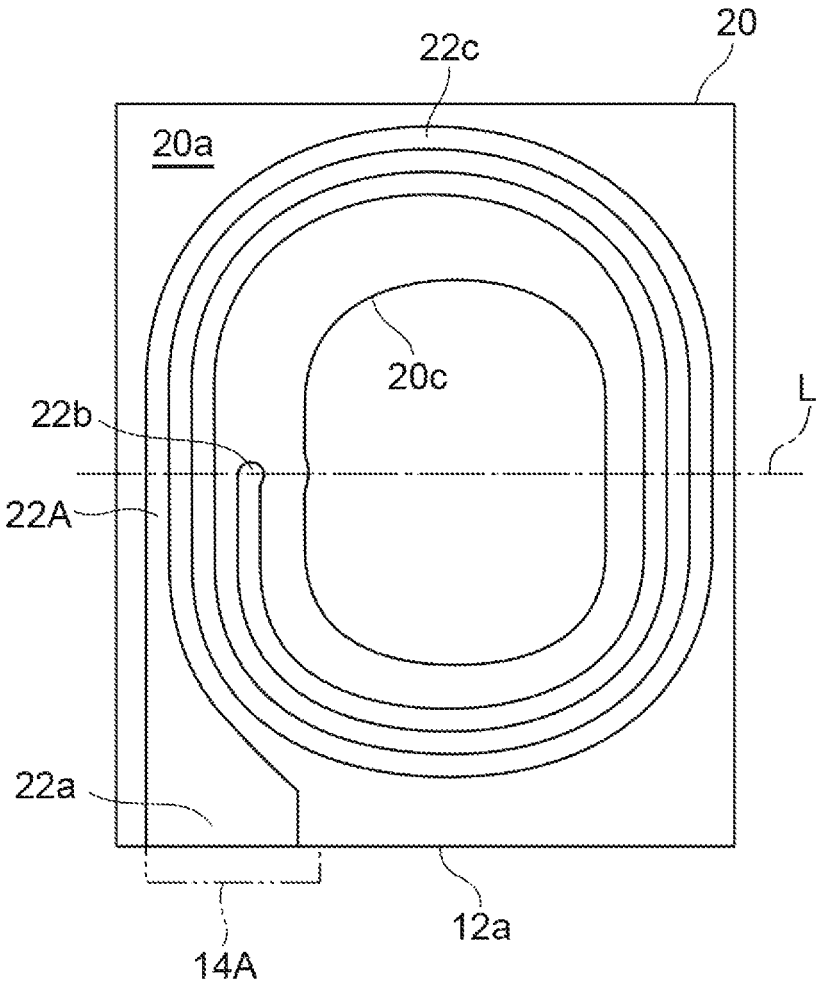
FIG. 5 is a view showing only a first planar coil pattern.

As shown in FIGS. 4 and 5, the inner end portion 22*b* of the first planar coil pattern 22A is located on the equidistant line L at the peripheral edge of the through hole 20*c*. In the form shown in FIGS. 4 and 5, the inner end portion 22*b* of the first planar coil pattern 22A is located on the left side of the through hole 20*c*. The first through conductor 26 which extends in the thickness direction of the insulating substrate 20 is provided at a position at which it overlaps the inner end portion 22*b* of the first planar coil pattern 22A. That is, the first through conductor 26 is located on the equidistant line L. The first through conductor 26 is in contact with the first planar coil pattern 22A on an upper end surface thereof and is in contact with the second planar coil pattern 22B on a lower end surface thereof.

The outer end portion 22*a* of the first planar coil pattern 22A extends to the end surface 12*a* and is connected to the first external terminal electrode 14A at the end surface 12*a*.

The winding portion 22*c* of the first planar coil pattern 22A constitutes the innermost and outermost turns of the planar coil patterns 22A and 22C provided on the upper surface 20*a* of the insulating substrate 20. The number of turns of the winding portion 22*c* of the first planar coil pattern 22A is about two turns (two turns).

Figure 6:
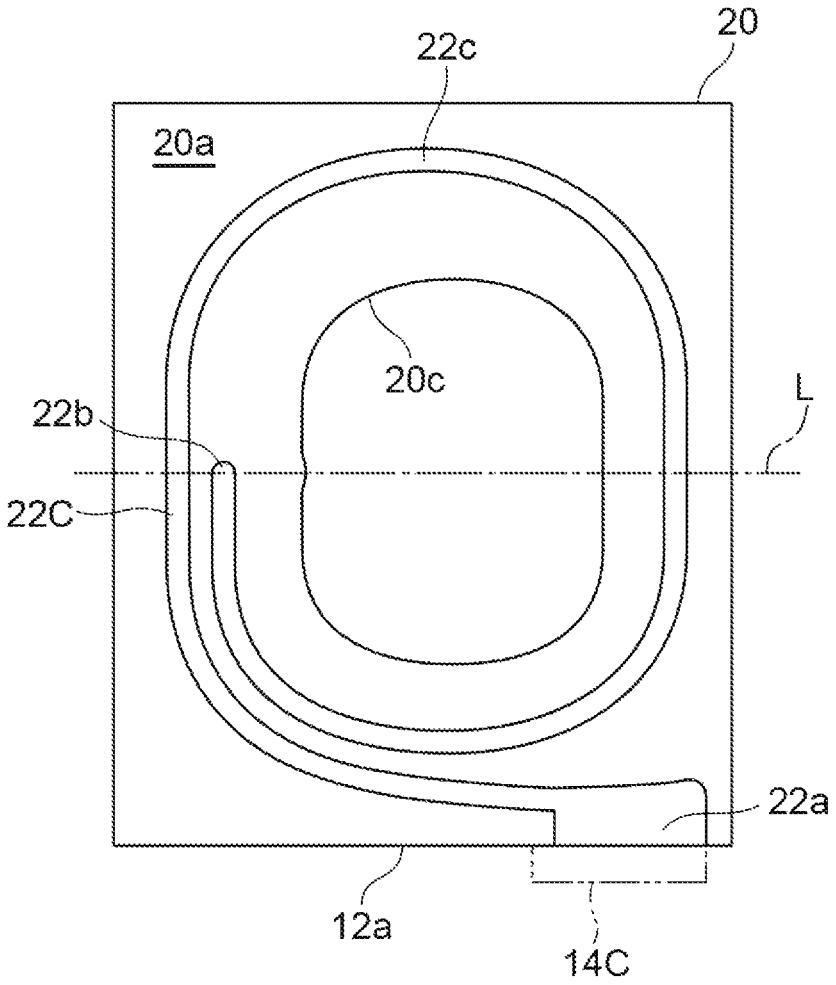
FIG. 6 is a view showing only a third planar coil pattern.

As shown in FIGS. 4 and 6, the inner end portion 22*b* of the third planar coil pattern 22C is located on the outer peripheral side (left side in the aspect shown in FIG. 4) of the first planar coil pattern 22A in the inner end portion 22*b* of the first planar coil pattern 22A on the equidistant line L at the peripheral edge of the through hole 20*c*, and is adjacent to the inner end portion 22*b* of the first planar coil pattern 22A.

The second through conductor 27 which extends in the thickness direction of the insulating substrate 20 is provided at a position at which it overlaps the inner end portion 22*b* of the third planar coil pattern 22C. That is, the second through conductor 27 is located on the equidistant line L and is adjacent to the first through conductor 26. The second through conductor 27 is in contact with the third planar coil pattern 22C on an upper end surface thereof and is in contact with the fourth planar coil pattern 22D on a lower end surface thereof.

The outer end portion 22*a* of the third planar coil pattern 22C extends to the end surface 12*a* and is connected to the third external terminal electrode 14C at the end surface 12*a*. In the form shown in FIG. 4, the outer end portion 22*a* of the third planar coil pattern 22C is located on the right side of the outer end portion 22*a* of the first planar coil pattern 22A.

The winding portion 22*c* of the third planar coil pattern 22C is wound to be adjacent to the winding portion 22*c* of the first planar coil pattern 22A. The number of turns of the winding portion 22*c* of the third planar coil pattern 22C is less than the number of turns of the winding portion 22*c* of the first planar coil pattern 22A, and is about one turn (one turn). Therefore, the winding portion 22*c* of the third planar coil pattern 22C is wound to be sandwiched between the winding portions 22*c* of the first planar coil pattern 22A.

Figure 7:
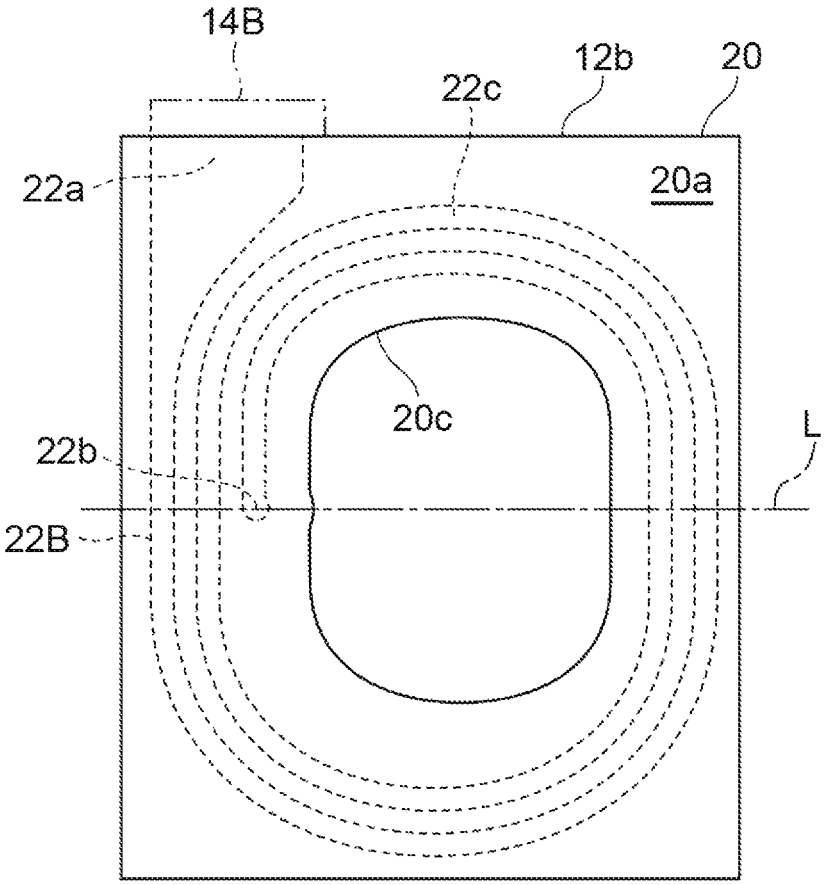
FIG. 7 is a view showing a second planar coil pattern provided on a lower surface of the substrate.

As shown in FIGS. 5 and 7, the pattern shape of the first planar coil pattern 22A and the pattern shape of the second planar coil pattern 22B have a line-symmetrical relationship with respect to the equidistant line L.

The inner end portion 22*b* of the second planar coil pattern 22B is located on the equidistant line L at the peripheral edge of the through hole 20*c*, and overlaps the inner end portion 22*b* of the first planar coil pattern 22A when seen in the thickness direction of the insulating substrate 20.

The outer end portion 22*a* of the second planar coil pattern 22B extends until it reaches the end surface 12*b*, and is connected to the second external terminal electrode 14B at the end surface 12*b*. The second external terminal electrode 14B is provided on the end surface 12*b* at a position corresponding to the first external terminal electrode 14A provided on the end surface 12*a*.

The winding portion 22*c* of the second planar coil pattern 22B constitutes the innermost and outermost turns of the planar coil patterns 22B and 22D provided on the lower surface 20*b* of the insulating substrate 20. The number of turns of the winding portion 22*c* of the second planar coil pattern 22B is about two turns, similar to the number of turns of the winding portion 22*c* of the first planar coil pattern 22A.

Figure 8:
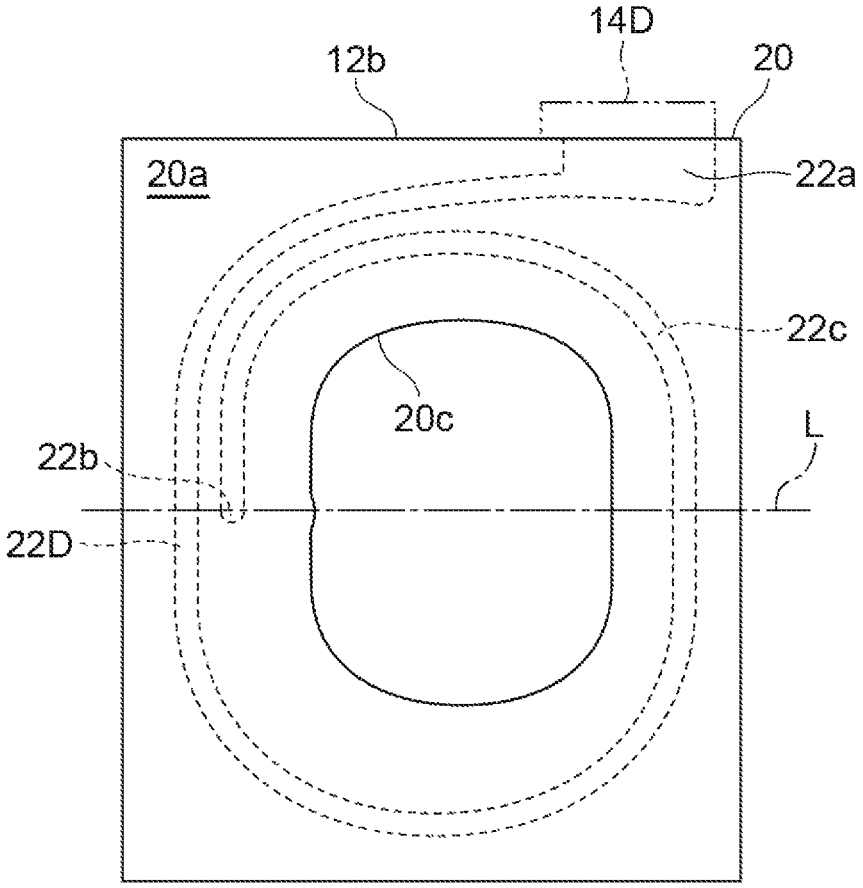
FIG. 8 is a view showing a fourth planar coil pattern provided on the lower surface of the substrate.

As shown in FIGS. 6 and 8, the pattern shape of the third planar coil pattern 22C and the pattern shape of the fourth planar coil pattern 22D have a line-symmetrical relationship with respect to the equidistant line L.

The inner end portion 22*b* of the fourth planar coil pattern 22D is located on the equidistant line L at the peripheral edge of the through hole 20*c*, and overlaps the inner end portion 22*b* of the third planar coil pattern 22C when seen in the thickness direction of the insulating substrate 20.

The outer end portion 22*a* of the fourth planar coil pattern 22D extends until it reaches the end surface 12*b*, and is connected to the fourth external terminal electrode 14D at the end surface 12*b*. The fourth external terminal electrode 14D is provided on the end surface 12*b* at a position corresponding to the third external terminal electrode 14C provided on the end surface 12*a*.

The winding portion 22*c* of the fourth planar coil pattern 22D is wound to be sandwiched between the winding portions 22*c* of the third planar coil pattern 22C, and does not constitute the innermost and outermost turns of the planar coil patterns 22B and 22D provided on the lower surface 20*b* of the insulating substrate 20. The number of turns of the winding portion 22*c* of the fourth planar coil pattern 22D is about one turn (one turn), similar to the number of turns of the winding portion 22*c* of the third planar coil pattern 22C.

In the above-described coil component 10, the double coil is configured of the first coil portion C1 and the second coil portion C2, and the first through conductor 26 of the first coil portion C1 and the second through conductor 27 of the second coil portion C2 are adjacent to each other. Thus, the first coil portion C1 and the second coil portion C2 have enhanced magnetic coupling at locations (that is, the first through conductor 26 and the second through conductor 27) at which the planar coil patterns 22A, 22B, 22C, and 22D of the upper and lower surfaces 20*a* and 20*b* of the insulating substrate 20 are connected, in addition to magnetic coupling in the planar coil patterns 22A, 22B, 22C, and 22D wound around the through hole 20*c*. Therefore, according to the coil component 10, a high coupling coefficient between the first coil portion C1 and the second coil portion C2 is realized.

Further, in the coil component 10, the number of turns of the first coil portion C1 is the sum of the number of turns of the winding portion 22*c* of the first planar coil pattern 22A and the number of turns of the winding portion 22*c* of the second planar coil pattern 22B, and is about 4 turns. On the other hand, the number of turns of the second coil portion C2 is the sum of the number of turns of the winding portion 22*c* of the third planar coil pattern 22C and the number of turns of the winding portion 22*c* of the fourth planar coil pattern 22D, and is about two turns. That is, the number of turns of the first coil portion C1 and the number of turns of the second coil portion C2 are different, and specifically, the number of turns of the first coil portion C1 is larger than the number of turns of the second coil portion C2. In the coil component 10, a value of inductance of the first coil portion C1 and a value of inductance of the second coil portion C2 are different from each other by making the number of turns of the first coil portion C1 and the number of turns of the second coil portion C2 different from each other.

Furthermore, in the coil component 10, when seen in the thickness direction (the Z direction) of the insulating substrate 20, as shown in FIGS. 5 and 7, the pattern shape of the first planar coil pattern 22A and the pattern shape of the second planar coil pattern 22B are line symmetric with respect to the equidistant line L, and as shown in FIGS. 6 and 8, the pattern shape of the third planar coil pattern 22C and the pattern shape of the fourth planar coil pattern 22D are line symmetric with respect to the equidistant line L. Since the pattern shapes of the planar coil patterns 22A, 22B, 22C, and 22D have symmetry in this way, a manufacturing process can be simplified. For example, types of mask patterns used during manufacturing can be reduced, the number of work processes can be reduced, and work time can be shortened. Further, when the planar coil patterns 22A, 22B, 22C and 22D are plated and molded, the planar coil patterns 22A, 22B, 22C and 22D can be plated and grown at a uniform speed by making plating formation regions on the upper and lower surfaces 20*a* and 20*b* of the insulating substrate 20 have the same area, and thus the planar coil patterns 22A, 22B, 22C, and 22D can be formed with high dimensional accuracy.

Further, in the coil component 10, the planar coil patterns 22A, 22B, 22C, and 22D formed on the respective surfaces of the insulating substrate 20 are separated from each other by the resin walls 24, and a region sandwiched between the adjacent resin walls 24 is the plating formation region of each of the planar coil patterns 22A, 22B, 22C, and 22D. An area of the plating formation region can be designed with high accuracy by defining the plating formation regions with the resin walls 24 in this way, and thus, the planar coil patterns 22A, 22B, 22C, and 22D can be formed with high dimensional accuracy.

The disclosure is not limited to the above-described embodiment, and may take various aspects.

For example, the planar coil patterns formed on the upper and lower surfaces of the insulating substrate do not have to be line symmetric with respect to the equidistant line. Further, the number of turns of the first coil portion and the number of turns of the second coil portion can be increased or decreased as appropriate. Further, a position of the outer end portion of each of the planar coil patterns (that is, a position at which the external terminal electrode is formed) can be appropriately changed.

What is claimed is:

1. A coil component, comprising:

an elementary body having a first end surface and a second end surface parallel to each other;

an insulating substrate provided in the elementary body, the insulating substrate having a through hole provided in a central portion thereof and being orthogonal to the first end surface and the second end surface and extending between the first end surface and the second end surface;

a first coil portion including a first planar coil pattern wound around the through hole of the insulating substrate, a second planar coil pattern wound around the through hole of the insulating substrate, and a first through conductor, the first planar coil pattern provided on one surface of the insulating substrate and wound around a magnetic core located on an equidistant line in which a distance from the first end surface and a distance from the second end surface are equal when seen in a thickness direction of the insulating substrate and having an inner end portion located on the equidistant line and an outer end portion extending to the first end surface of the elementary body, the second planar coil pattern provided on another surface of the insulating substrate and having an inner end portion overlapping the inner end portion of the first planar coil pattern and an outer end portion extending to the second end surface of the elementary body when seen in the thickness direction of the insulating substrate, the first through conductor piercing the insulating substrate in the thickness direction on the equidistant line when seen in the thickness direction of the insulating substrate and connecting the inner end portion of the first planar coil pattern to the inner end portion of the second planar coil pattern;

a second coil portion including a third planar coil pattern wound around the through hole of the insulating substrate, a fourth planar coil pattern wound around the through hole of the insulating substrate, and a second through conductor, the third planar coil pattern provided on the one surface of the insulating substrate to be wound parallel to the first planar coil pattern and having an inner end portion adjacent to the inner end portion of the first planar coil pattern on an outer peripheral side of the first planar coil pattern and an outer end portion extending to the first end surface of the elementary body on the equidistant line when seen in the thickness direction of the insulating substrate, the fourth planar coil pattern provided on the other surface of the insulating substrate and having an inner end portion overlapping the inner end portion of the third planar coil pattern and an outer end portion extending to the second end surface of the elementary body when seen in the thickness direction of the insulating substrate, the second through conductor piercing the insulating substrate in the thickness direction to be adjacent to the first through conductor on a same side of the elementary body relative to the through hole of the insulating substrate on the equidistant line when seen in the thickness direction of the insulating substrate and connecting the inner end portion of the third planar coil pattern to the inner end portion of the fourth planar coil pattern;

a first external terminal electrode provided on the first end surface of the elementary body and connected to the outer end portion of the first planar coil pattern;

a second external terminal electrode provided on the second end surface of the elementary body and connected to the outer end portion of the second planar coil pattern;

a third external terminal electrode provided on the first end surface of the elementary body and connected to the outer end portion of the third planar coil pattern; and a fourth external terminal electrode provided on the second end surface of the elementary body and connected to the outer end portion of the fourth planar coil pattern.

2. The coil component according to claim 1, wherein a number of turns of the first coil portion is larger than a number of turns of the second coil portion.

3. The coil component according to claim 1, wherein a pattern shape of the first planar coil pattern and a pattern shape of the second planar coil pattern are line symmetric with respect to the equidistant line, and a pattern shape of the third planar coil pattern and a pattern shape of the fourth planar coil pattern are line symmetric with respect to the equidistant line when seen in the thickness direction of the insulating substrate.

4. The coil component according to claim 1, wherein the first planar coil pattern, the second planar coil pattern, the third planar coil pattern, and the fourth planar coil pattern are configured by plating, and the first planar coil pattern and the third planar coil pattern provided on the one surface of the insulating substrate, and the second planar coil pattern and the fourth planar coil pattern provided on the other surface of the insulating substrate are separated by resin walls.

* * * * *